US005915733A

United States Patent [19]

Schnitzer et al.

[11] Patent Number: 5,915,733

[45] Date of Patent: Jun. 29, 1999

[54] BUSINESS FORM INCORPORATING A REMOVABLE IDENTIFICATION CARD

[75] Inventors: David H. Schnitzer, Buffalo Grove; Gerard J. Maynard, Barrington, both of Ill.

[73] Assignee: The Standard Register Company, Dayton, Ohio

[21] Appl. No.: 08/760,947

[22] Filed: Dec. 9, 1996

[51] Int. Cl.[6] ..... B42D 15/00

[52] U.S. Cl. ..... 283/108; 283/107; 283/109; 283/110; 283/74; 283/75; 283/67

[58] Field of Search ..... 283/107, 108, 283/109, 110, 101, 81, 74, 75, 67; 462/6, 25, 26, 64, 65, 900

[56] References Cited

U.S. PATENT DOCUMENTS

| | | | |
|---|---|---|---|
| Re. 29,127 | 2/1977 | Janssen . | |
| Re. 33,727 | 10/1991 | Sims . | |
| D. 352,310 | 11/1994 | Edwards . | |
| D. 361,593 | 8/1995 | Edwards . | |
| 4,208,235 | 6/1980 | Stewart . | |
| 4,281,762 | 8/1981 | Hattemer . | |
| 4,307,526 | 12/1981 | Wippern . | |
| 4,359,358 | 11/1982 | Hattemer . | |
| 4,379,573 | 4/1983 | Lomeli et al. . | |
| 4,394,904 | 7/1983 | Larimore . | |
| 4,479,838 | 10/1984 | Dunsirn et al. . | |
| 4,505,770 | 3/1985 | Larimore . | |
| 4,506,371 | 3/1985 | Cross et al. . | |
| 4,526,405 | 7/1985 | Hattemer . | |
| 4,528,055 | 7/1985 | Hattemer . | |
| 4,661,189 | 4/1987 | Voy et al. . | |
| 4,854,610 | 8/1989 | Kwiatek . | |
| 5,011,559 | 4/1991 | Felix . | |
| 5,096,229 | 3/1992 | Carlson . | |
| 5,098,759 | 3/1992 | Felix . | |
| 5,129,682 | 7/1992 | Ashby . | |
| 5,131,686 | 7/1992 | Carlson . | |
| 5,139,836 | 8/1992 | Burke . | |
| 5,161,687 | 11/1992 | Kornell et al. . | |
| 5,271,787 | 12/1993 | Hoffmann et al. . | |
| 5,279,875 | 1/1994 | Juszak et al. . | |
| 5,320,387 | 6/1994 | Carlson . | |
| 5,346,739 | 9/1994 | Nassoiy | 283/108 |
| 5,351,426 | 10/1994 | Voy et al. . | |
| 5,352,155 | 10/1994 | Fashey | 283/81 |
| 5,376,418 | 12/1994 | Rogers et al. . | |
| 5,403,236 | 4/1995 | Greig | 283/75 |
| 5,410,136 | 4/1995 | McIntire et al. . | |
| 5,413,830 | 5/1995 | Edwards . | |
| 5,427,832 | 6/1995 | Longtin . | |
| 5,439,255 | 8/1995 | McIntire et al. . | |
| 5,464,254 | 11/1995 | Campbell et al. | 283/107 |
| 5,466,013 | 11/1995 | Garrison | 283/107 |
| 5,482,328 | 1/1996 | Stewart | 283/81 |
| 5,482,753 | 1/1996 | Langan et al. | 283/107 |
| 5,509,693 | 4/1996 | Kohls . | |
| 5,522,956 | 6/1996 | McCannel . | |
| 5,529,345 | 6/1996 | Kohls . | |
| 5,562,789 | 10/1996 | Hoffmann . | |
| 5,573,825 | 11/1996 | Brewster . | |
| 5,595,403 | 1/1997 | Garrison . | |
| 5,632,511 | 5/1997 | Longton et al. . | |
| 5,660,896 | 8/1997 | Normand et al. . | |
| 5,667,247 | 9/1997 | Ramsburg et al. . | |
| 5,756,175 | 5/1998 | Washburn . | |

*Primary Examiner*—Frances Han

*Attorney, Agent, or Firm*—Killworth, Gottman, Hagan & Schaeff, LLP

[57] ABSTRACT

Difficulties with removing an identification card as part of a business form and/or costs concerns in making such business forms with readily removable cards are avoided in a business form incorporating a removable identification card made by the steps of a) providing a base sheet (10) of a relatively destructible material such as paper and having an area (20) intended to be an identification card; b) adhering a laminate layer (30), (34) of relatively indestructible material to the base sheet (10) to cover the area (20) on at least the underside of the base sheet (10); c) placing a layer of adhesive (50), (52) on the laminate layer (34) and to the sides (40), (42), (44), (46) thereof to be on the base sheet (10) adjacent the laminate layer (34); d) adhering a liner layer (56) to the laminate layer (34) and the base sheet (10) with the layer of adhesive (50), (52) and e) placing a continuous, closed die cut (26) about the area with the die cut extending through the laminate layer (30), (34) and the base sheet (10) but not through the liner layer (56).

14 Claims, 1 Drawing Sheet

BUSINESS FORM INCORPORATING A REMOVABLE IDENTIFICATION CARD

FIELD OF THE INVENTION

This invention relates to business forms, and more particularly, to business forms that removably incorporate an identification card.

BACKGROUND OF THE INVENTION

The use of computerized printing systems has seen a considerable increase in business forms of all types. One type of form that is seeing a substantial increase in usage is a business form that incorporates a removable identification card. Identification cards of the type of concern may be used for a large variety of purposes including conventional identification or as cards that identify a person as being a member of a particular group such as a charitable, environmental or health maintenance organization. They may also be used to indicate insurance limits for a particular individual as well as many, many other diverse purposes. That is to say, as used herein, the term "identification card" refers to cards incorporated in business forms that may be used for any of a vast number of purposes, and not simply solely for purely identification purposes.

Cards of this type are increasingly favored over more conventional type of cards such as the conventional, plastic card such as a credit card. Conventional cards require embossing of so-called variable information into the card itself and this is considerably more expensive than merely printing the information on the card as can be accomplished with a business form that incorporates an identification card.

In the usual case, such a business form incorporating an identification card will be formed of a base sheet of relatively destructible material as, for example, paper. To provide a measure of toughness and indestructibility to the identification card, it will be typically provided, on one or both sides, with a laminate layer of tough, transparent, relatively indestructible material as, for example, polyester film.

In manufacturing such forms, so-called fixed information will be printed on the base sheet prior to the application of one or both polyester laminate layers. Fixed information is the information that remains the same from one card to the next in a series of cards. Variable information may be applied to the card either before or after the application of the laminate layer or layers thereto. Variable information is information that will vary from one card to the next as, for example, a name, an address, insurance policy limits, etc. The time at which variable information is applied depends upon whether it is being applied by the manufacturer of the business form, or the customer of the manufacturer. When the manufacturer is applying the variable information, it will be done prior to the application of the laminate layer while if the customer is applying the variable information, it will be applied to the laminate layer on the fully assembled business form.

It is, of course, necessary that the identification card be readily removable from the remainder of the business form by the recipient of the card. At the same time, it is necessary that the card be firmly attached to the remainder of the business form during processing and the imprintation of both fixed and variable information thereon. To accomplish both purposes, many business forms incorporating identification cards define the card by a line of perforation. The recipient breaks the perforations in the line, thereby severing the identification card from the remainder of the business form. One problem with such a construction is the fact that the laminate layer is formed of tough, relatively indestructible material to give body and strength to the remainder of the card. It is, by nature, difficult to tear and as a consequence, difficulty may be experienced in breaking the perforations in a line of perforation.

To avoid this, resort has been made to a material referred to as "Lite-Lift dry material" furnished by JAC paper. This is a material that adheres to the card and which allows the card to be lifted from the remainder of the form with the Lite-Lift dry material remaining with the business form so that the identification card will be free from the material.

When using such a material, it is desirable to incorporate an adhesive free area at each edge of the card and then tip the card onto the business form that serves as the carrier for the same.

However, as card size may vary to some degree, the Lite-Lift dry material must be custom manufactured for each different type of card to provide the adhesive free area. This means that a certain amount of lead-time is required to order and obtain the Lite-Lift dry material before the business forms incorporating the removal card can be completely manufactured.

Furthermore, Lite-Lift dry material is not inexpensive and therefore, its cost limits customer demand for this sort of product.

The present invention is directed to overcoming one or more of the above problems.

SUMMARY OF THE INVENTION

It is the principal object of the invention to provide a new and improved business form incorporating a removable identification card. It is also a principal object of the invention to provide a new and improved method for making such a card.

According to one facet of the invention, a business form removably incorporating an identification card is provided and includes a base sheet formed of a readily destructible material such as paper and has an area intended to serve as an identification card. A laminate layer having edges and of tough, relatively non-destructible material such as polyester is adhered to the base sheet on its underside and completely covers the area and extends past the sides thereof. A closed, continuous die cut is disposed in the base sheet and in the laminate layer and defines the area and the identification card and frees the identification card from the remainder of the base sheet and the laminate layer. A layer of adhesive is disposed on the side of the laminate layer opposite the base sheet and extends past the edges of the laminate layer to adhere to the base sheet at locations past the edges. A liner layer is adhered to the base sheet and to the laminate layer by the layer of adhesive. The layer of adhesive releasably adheres to the laminate layer and non-releasably adheres to the liner layer, thereby holding the card in place during processing but allowing easy removal without any need to break perforations.

According to another facet of the invention, there is provided a method of making a business form incorporating a removable identification card which comprises the steps of:

(a) providing a base sheet of a relatively destructible material and having an area intended to be an identification card;

(b) adhering a laminate layer of relatively indestructible material to the base sheet to cover the area on at least the underside of the base sheet;

(c) placing a layer of adhesive on the laminate layer and, to the sides thereof, on the base sheet adjacent the laminate layer;

(d) adhering a liner layer to the laminate layer and the base sheet with the layer of adhesive; and (e) placing a continuous, closed die cut about the area, the die cut extending through the laminate layer or layers and the base sheet but not through the liner layer.

Other objects and advantages will become apparent from the following specification taken in connection with the accompanying drawings.

DESCRIPTION OF THE PREFERRED EMBODIMENT

Figure 1:
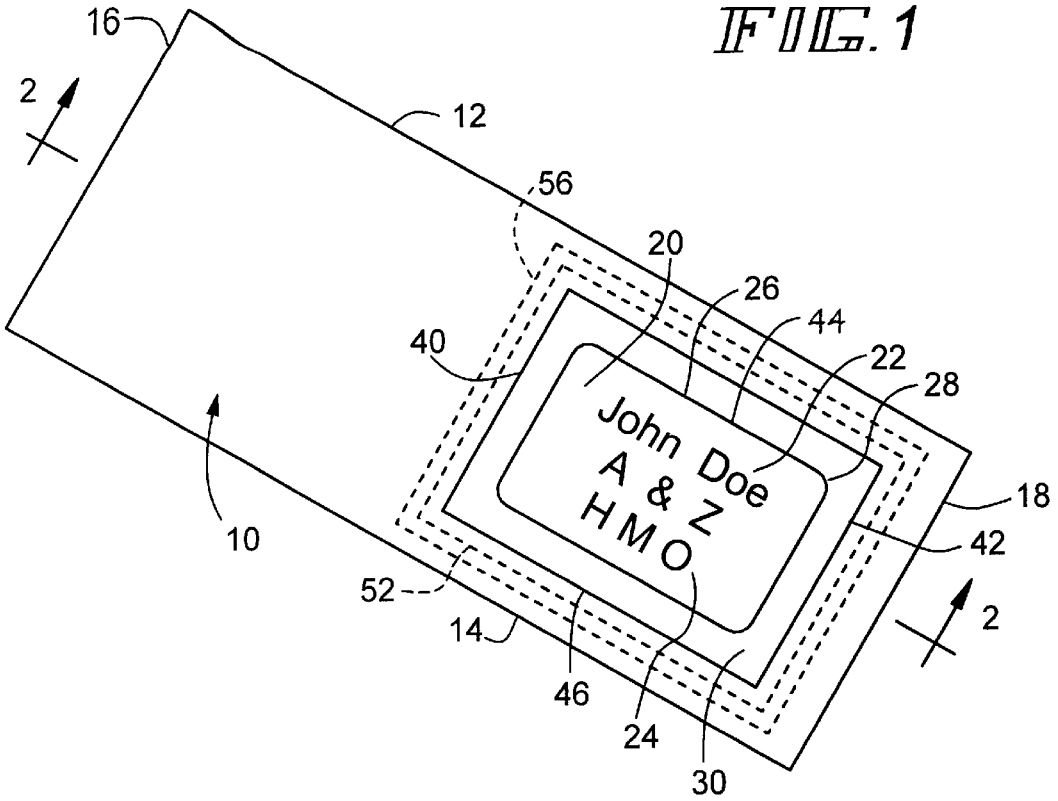
FIG. 1 is a perspective view of a business form incorporating a removable identification card and made according to the invention.

A business form incorporating a removable identification card and made according to the invention is seen in the drawings and with reference to FIG. 1, includes a base sheet, generally designated 10. The base sheet 10 will be made of a relatively destructible material such as paper. While the base sheet 10 is shown as a sheet in FIG. 1, those skilled in the art will readily recognize that the invention contemplates the formation of the business form shown in FIG. 1 in continuous form. In such a case, the base sheet 10 will be defined by transverse lines of weakening in a continuous ply of paper, the transverse lines of weakening defining upper and lower edges 12 and 14 respectively of the sheet 10. In addition, control punch margins (not shown) will be located at the side edges 16 and 18 for use in the manufacturing process and possibly in subsequent processing as well, all as is well known.

In the illustrated embodiment, the base sheet 10 includes an area 20 that is intended to define an identification card. As illustrated in FIG. 1, printed within the area 20 is variable information 22 such as the name of the cardholder. Also printed within the area 20 is fixed information 24 such as the identity of the organization to which the identified person belongs.

The area 20 is surrounded by a continuous, closed, generally rectangular die cut 26. The corners are rounded as at 28 to prevent them from being dog eared in use. The die cut 26 is continuous in the sense that it is substantially uninterrupted as by ties separating cuts that define a conventional line of perforation. This absence of ties, as will be seen, allows removal of the identification card from the remainder of the business form without the breaking of any components, thereby enabling simple removal.

Figure 2:
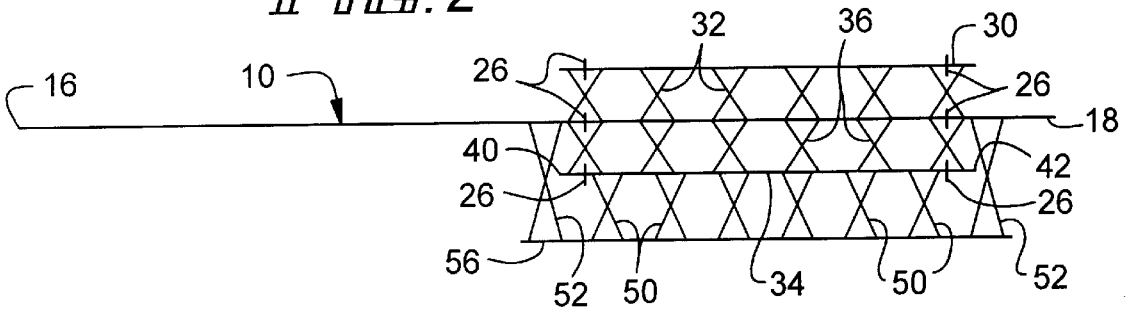
FIG. 2 is a schematic, sectional view taken along the line 2—2 in FIG. 1.

Referring to FIG. 2, the upper surface of the base sheet 10 is provided with a patch 30 of tough, transparent, relatively indestructible material such as a polyester film having a thickness of 0.0005" to about 0.005". Glue represented by "X's" 32 adheres the polyester layer 30, also referred to as a laminate layer, to the upper surface of the base sheet 10. It is to be particularly observed that the laminate layer 30 is optional and may not be present in all embodiments of the invention.

On the underside of the base sheet, a laminate layer 34 is located. The laminate layer 34 is adhered to the base sheet 10 and its underside by adhesive 36. The laminate layer 34 is also formed of a tough, relatively non-destructible, transparent material such as polyester film of the thickness mentioned above.

Both of the layers 30 and 34 will completely cover the area 20 and typically, but not always, will have the same rectangular shape. In this regard, it will be observed that the die cut 26 is not only located in the base sheet 10, but located in the laminate layer 34 as well as the laminate layer 30 if present. The die cut 26 will be located within the side edges 40 and 42 as well as the top and bottom edges 44 and 46 of the patches as defining the laminate layers 30 and 34.

Referring again to FIG. 2, an adhesive layer formed of adhesive represented by "X's" 50 and 52 is applied to the laminate layer 34 on the side thereof opposite from the base sheet 10. Alternatively, the adhesive could be applied to a liner layer to be described. It is to be particularly observed that the adhesive layer 50, 52 extends past each of the edges 40, 42, 44, 46 of the laminate layer 34. Thus, as illustrated in FIG. 2, the adhesive 50 is located within the confines of the laminate layer 34 while the adhesive 52 is located beyond the edges 40, 42, 44, 46. It should be understood, however, that the use of different reference numerals is strictly to distinguish between locations and the adhesive used is the same and typically applied at the same time and in the same operation in a preferred embodiment of the invention.

What this means, of course, is that the adhesive 50, 52 not only covers the laminate layer 34, but it extends to and is adhered to the base sheet 10 in generally surrounding relation to the laminate layer 34.

The structure is completed by a liner layer 56 of rectangular configuration and which is somewhat larger than the outline of the adhesive layer 50, 52 so as to extend beyond the edges of the adhesive layer 50, 52 as can be seen in FIG. 1. The liner layer 56 will generally be uncoated paper. As a consequence, the adhesive in the area 52 will adhere the liner layer 56 to the base sheet 10 in a non-removable fashion. At the same time, the adhesive 50, 52 will releasably adhere to the laminate layer 34. Thus, because the liner layer 56 will be of, for example, an uncoated paper, when one attempts to separate the card defined by the area 20 of the base sheet 10, the laminate layer 34 and the laminate layer 30, if present, the adhesive 50, 52 will remain on the liner layer 56 allowing the card to be easily removed without breaking any perforations or the like. As generally alluded to previously, the adhesive layer 50, 52 optionally may be adhered first to the liner layer 56 which then may be applied and adhered to the laminate layer 34 and the base sheet 10.

As noted previously, generally speaking, the edges of the adhesive layer 50, 52 will stop short of the edges of the liner layer 56. This means that there will be no adhesive 50, 52 oozing out from the interface of the components such as to raise the potential for causing difficulties during processing. All such adhesive will be fully covered by the liner layer 56. The only time that the adhesive 50, 52 will be exposed will be after the card has been removed from the remainder of the assemblage, at which time the remainder of the business form has served its purpose and may be disposed of.

It should also be appreciated that while the laminate layers 30, 34 have been described as rectangular patches that have been tipped on in superimposed relation to the area 20, they could be formed of strips that extend completely between the top and bottom edges 12 and 14 of the base sheet 10.

In manufacture, the base sheet 10 will be provided with at least the laminate layer 34 and possibly the optional laminate layer 30 as well. Thereafter, the adhesive 50, 52 will be applied to the appropriate location as described above followed by the application of the liner layer 56. When that has been accomplished, the die cut 26 will be formed through the laminate layers 30 and 34 as well as in surrounding relationship to the area 20 in the base sheet 10. The die cut 26 will not, however, penetrate the liner layer 56 which thus serves as a means whereby the completely freed identification card is releasably adhered to the base sheet 10.

As with prior art cards of this general type, the printing of variable information can occur either before or after the application of the laminate layer or layers 30, 34.

From the foregoing, it will be appreciated that the business form and method of the present invention overcome the difficulties encountered with certain prior art forms in separating the business card from the remainder of the business form along a line of perforation by virtue of the use of a continuous, closed die cut 26. At the same time, problems associated with lead time and cost occasioned by the use of other prior art materials are avoided through the use of a simple adhesive layer 50, 52 and the liner layer 56.

We claim:

1. A business form removably incorporating an identification card comprising:

a base sheet formed of a readily destructible material such as paper and having an area intended to serve as an identification card;

a laminate layer having edges and of tough, relatively non-destructible material such as polyester adhered to said base sheet on its underside and completely covering said area and extending past the side thereof;

a closed, continuous die cut in said base sheet and said laminate layer and defining said area and said identification card for freeing said identification card from the remainder of said base sheet and said laminate layer;

a layer of adhesive on the side of said laminate layer opposite said base sheet and extending past said edges to adhere to said base sheet at locations past said edges; and a liner layer adhered to said base sheet and said laminate layer by said layer of adhesive;

said layer of adhesive releasably adhering to said laminate layer and non-releasably adhering to said liner layer.

2. The business form of claim 1 wherein said adhesive layer has edges and said liner layer extends past said adhesive layer edges so as to prevent the exposure of the adhesive of said adhesive layer except when said identification card is removed.

3. The business form of claim 1 wherein said laminate layer is generally rectangular and has four said laminate layer edges; and said adhesive layer extends past all said laminate layer edges.

4. The business form of claim 3 wherein said adhesive layer is generally rectangular and has four said adhesive layer edges; and said liner layer extends past all said adhesive layer edges.

5. The business form of claim 3 wherein said adhesive layer has edges and said liner layer extends past said adhesive layer edges so as to prevent the exposure of the adhesive of said adhesive layer except when said identification card is removed.

6. The business form of claim 1 wherein said adhesive layer has edges and said liner layer extends past said adhesive layer edges.

7. The business form of claim 6 wherein said adhesive layer is generally rectangular and has four said adhesive layer edges; and said liner layer extends past all said adhesive layer edges.

8. The business form of claim 1 further including a second laminate layer completely covering said area and located on and adhered to the side of said base sheet opposite said first mentioned laminate layer; said die cut additionally extending through said second laminate layer.

9. A method of making a business form incorporating a removable identification card, comprising:

a) providing a base sheet of a relatively destructible material and having an area intended to be an identification card;

b) adhering a laminate layer of relatively indestructible material to said base sheet to cover said area on at least the underside of said base sheet;

c) placing a layer of adhesive on said laminate layer and, to the sides thereof, on said base sheet adjacent said laminate layer;

d) adhering a liner layer to said laminate layer and said base sheet with said layer of adhesive; and e) placing a continuous closed die cut about said area, said die cut extending through said laminate layer(s) and said base sheet but not through said liner layer.

10. The method of claim 9 wherein steps a), b), c), d) and e) are performed in the sequence listed.

11. The method of claim 9 further including the step of printing variable information on said removable card.

12. The method of claim 11 wherein the step of printing variable information precedes the performance of step b).

13. The method of claim 11 wherein the step of printing variable information follows the performance of step b).

14. The method of claim 9 wherein steps c) and d) are performed by first adhering said layer of adhesive to said liner layer and then adhering said liner layer with said layer of adhesive thereon to said laminate layer and said base sheet.

* * * * *